United States Patent [19]

Olson

[11] 4,261,438

[45] Apr. 14, 1981

[54] LIFT TRUCK MAST HAVING HIGH VISIBILITY AND EXTENSIBILITY

[75] Inventor: Harlan D. Olson, Sandy, Oreg.

[73] Assignee: Cascade Corporation, Portland, Oreg.

[21] Appl. No.: 58,562

[22] Filed: Jul. 18, 1979

[51] Int. Cl.[3] ..... B66B 9/20

[52] U.S. Cl. ..... 187/9 E; 414/631

[58] Field of Search ..... 187/9 R, 9 E, 17; 414/631, 641; 91/168

[56] References Cited

U.S. PATENT DOCUMENTS

| | | | |
|---|---|---|---|
| Re. 27,731 | 8/1973 | McIntosh | 187/9 R |
| 3,051,265 | 8/1962 | Boyajian et al. | 187/9 E |
| 3,172,339 | 3/1965 | Quayle . | |
| 3,188,917 | 6/1965 | Quayle | 187/9 E |
| 3,235,033 | 2/1966 | Quayle | 187/9 E |
| 3,235,034 | 2/1966 | Quayle | 187/9 E |
| 3,394,778 | 7/1968 | Brinton | 187/9 E |
| 3,638,761 | 2/1972 | Ohta | 187/9 E |
| 3,968,859 | 7/1976 | Ehrhardt | 187/9 E |
| 4,008,648 | 2/1977 | Farmer et al. | 91/168 |
| 4,026,432 | 5/1977 | Abels | 187/9 E |

FOREIGN PATENT DOCUMENTS

| | | | |
|---|---|---|---|
| 1182962 | 8/1967 | United Kingdom | 187/9 E |

*Primary Examiner*—F. J. Bartuska
*Assistant Examiner*—Kenneth Noland
*Attorney, Agent, or Firm*—Chernoff & Vilhauer

[57] ABSTRACT

An extensible-contractible four-stage telescopic mast for a lift truck having a single fluid-actuated ram of low-collapsed height for high visibility which accomplishes both free lift and mast extension. The associated chain reeving of the mast provides a lesser ratio of load carriage speed to ram extension speed during free lift than during mast extension. To obtain substantially uniform speed of the load carriage throughout its lifting range, the ram assembly has a variable speed of extension substantially inversely proportional to such ratio such that ram speed is higher during free lift than during mast extension. An arrangement of the four mast sections, associated chain reeving and hydraulic conduits is provided which is especially conducive to high visibility and maximum load capacity.

12 Claims, 9 Drawing Figures

LIFT TRUCK MAST HAVING HIGH VISIBILITY AND EXTENSIBILITY

BACKGROUND OF THE INVENTION

This invention relates to improvements in load-lifting mast assemblies for lift trucks. More particularly the invention relates to highly extensible free lift masts, especially four-stage masts, which provide a high degree of forward visibility for the lift truck operator while the truck is traveling with the load carriage substantially lowered, substantially uniform speed of the load carriage throughout its range of travel and maximum load-carrying capacity.

Highly extensible lift truck mast assemblies, particularly those of the four-stage type, present difficult problems with respect to resolving various competing design objectives. These competing objectives include:

(1) high forward visibility;

(2) substantially uniform speed of the load carriage throughout its range of travel;

(3) "free lift", i.e. initial raising of the load without simultaneous mast extension; and (4) minimum extension of the load forwardly of the lift truck front axle to maximize load-carrying capacity.

In a number of prior four-stage masts, free lift is provided by utilizing two separately-actuatable hydraulic rams, one being mounted upon the inner mast section for raising the load carriage relative thereto during free lift, and the other ram being mounted on another mast section at a position behind the first ram for extending the mast. Such fore-and-aft placement of two separate hydraulic rams, however, tends to maximize the fore-and-aft dimension of the mast assembly, thereby maximizing the extension of the load carriage forwardly of the lift truck front axle and thereby diminishing the load-lifting capacity of the truck. Moreover it is virtually impossible, as a practical matter, to provide both rams with a low collapsed height (preferably half the height of the fully-contracted mast) necessary for a high degree of operator forward visibility with the load carriage in a substantially lowered transporting position, because of the inordinate number (four) of separate lift chain sets which would be required to provide both free lift and full mast extension with two separate rams of such low collapsed height.

One four-stage mast, similar to the three-stage mast shown in McIntosh U.S. Pat. No. RE 27,731, has previously been conceived wherein an outer mast section and an additional set of lifting chains for extending the mast sections are added to the three-stage structure shown in the patent. The resultant device, while avoiding a fore-and-aft dual ram arrangement, does not provide a ram assembly having a low collapsed height as is required for good operator forward visibility. Rather the collapsed ram assembly is the same height as the fully-contracted mast and therefore remains directly in the center of the operator's view when the load carriage is in the lowered or transporting position. Moreover load carriage speed, assuming a uniform volumetric flow of fluid into the ram assembly, must be substantially higher during mast extension than during free lift because the ram assembly relies on "hydraulic sequencing" to ensure that free lift precedes mast extension during elevation of the load. That is, mast extension must require a substantially higher hydraulic pressure than does free lift to ensure that free lift precedes mast extension.

Although it would be possible to improve the operator visibility of the four-stage mast described in the previous paragraph by substituting therein a ram assembly of the type shown in Quayle U.S. Pat. Nos. 3,172,339, 3,235,033 or 3,235,034 because such ram assembly, being of the three-stage type, collapses to a height approximately equal to two-thirds of the height of the fully-contracted mast, the problem of nonuniformity of load carriage speed would become substantially worse. This is due to the fact that the four-stage mast chain reeving provides only a two-to-one ratio of load carriage speed to ram extension speed during free lift while providing a three-to-one ratio during mast extension, coupled with the fact that the effective hydraulic working area of the Quayle type of ram assembly becomes smaller as the ram extends causing the ram to extend gradually faster assuming a uniform volumetric flow of hydraulic fluid into the ram assembly. Thus load carriage speed would be more than 50% higher during mast extension than during free lift assuming a uniform volumetric supply of hydraulic fluid, such increase in speed being unacceptable from a viewpoint of operator control and safety during lifting operations.

The achievement of all of the above-listed competing objectives in a mast having only three stages is exemplified by the structure shown in the Farmer et al U.S. Pat. No. 4,008,648, the disclosure of which is hereby incorporated herein by reference. Here a single ram assembly having a low collapsed height (reaching only to approximately the longitudinal midpoint of the fully-contracted mast) provides both free lift and mast extension. Uniform speed of the load carriage throughout its entire range of travel is ensured by chain reeving which provides a ratio of two-to-one between carriage speed and ram extension speed during both free lift and mast extension, and by an internal ram structure which provides for constant ram extension speed when pressurized fluid is introduced thereto at a substantially constant rate. The constant-speed ram approach taught by this patent to resolve the aforementioned objectives cannot, however, be applied to a four-stage mast and would, in fact, be counter-productive with respect to the objective of uniform load carriage speed because the mast extension chains of a four-stage mast, for optimum design, would provide a substantially higher ratio of carriage speed to ram extension speed during mast extension than during free lift, in contrast to a comparable three-stage construction where the ratios are the same.

Other problems encountered in the construction of four-stage masts relate to the arrangement of four high-strength mast sections in transverse, side-by-side relationship, together with associated multiple sets of lift chains and hydraulic conduits, without requiring inordinate space in both the transverse and fore-and-aft directions so as to maximize visibility and minimize extension of the load forwardly of the lift truck front axle. In prior three-stage masts such objectives have been accomplished by means of staggered mast nesting arrangments such as those shown in British Pat. No. 1,182,962 and Ohta U.S. Pat. No. 3,638,761. Moreover, an advantageous chain arrangement for three-stage masts, also for aiding operator visibility, is shown in the aforementioned McIntosh U.S. Pat. No. RE 27,731. With four-stage masts however, the problem of minimizing the required space is substantially more severe due to the presence of one additional mast section, at least one additional set of lifting chains and additional hydraulic conduits necessary to accommodate the four-stage arrangement.

SUMMARY OF THE INVENTION

The present invention is directed to a lift truck mast assembly having a particular combination of mutually-cooperative features which enable all of the above-listed competing objectives to be achieved in a four-stage mast.

The mast utilizes a single, multisection hydraulic ram assembly for compactness of the mast in the fore-and-aft direction, such ram assembly having a low collapsed height substantially coincident with the longitudinal midpoint of the fully-contracted mast for providing a high degree of operator forward visibility through the mast when the load carriage and load are in a substantially lowered position for transporting. The base of the ram assembly is mounted on the inner intermediate mast section and full free lift is provided by a set of lifting chains which provides a ratio of two-to-one between the respective carriage and ram extension speeds during free lift. In contradistinction, two other sets of lifting chains provide a three-to-one ratio between the carriage and ram extension speeds during mast extension. To provide substantially uniform load carriage speed throughout its entire range of travel requires no substantial change in carriage speed at the transition from free lift to mast extension. To accomplish this, the present invention features a ram assembly having multiple extensible sections wherein, assuming a constant rate of supply fluid to the ram assembly, the assembly initially extends at a faster rate during free lift than it subsequently does during mast extension, the relation between ram extension speeds during the initial and subsequent portions of ram extension being substantially inversely proportional to the relation between the ratios of carriage speed to ram extension speed during initial free lift and subsequent mast extension respectively. It will be appreciated that this result is functionally impossible to achieve with previous multisection ram assemblies, particularly those of relatively low collapsed height, wherein "hydraulic sequencing" is utilized, because such hydraulic sequencing relies on the principle of higher hydraulic pressure (and faster speed) being required for the subsequent function (i.e. mast extension) than for the prior function (i.e. free lift). The desired uniformity of load carriage speed is accomplished in the present invention by structure which is totally integral with and within the ram assembly, rather than by troublesome external latching arrangements which have sometimes been used in the past to ensure proper sequence of mast operation as an alternative to hydraulic sequencing.

Although ideally the reduction in ram extension speed should occur coincidentally with the transition between free lift and mast extension, the mechanical difficulty in reliably achieving such coincidence makes it preferable that the ram assembly be designed so as to reduce its extension speed slightly in advance of the transition from free lift to mast extension to avoid a momentary high-speed surge of the load carriage accompanied by a momentary high-pressure surge in the hydraulic system. In this way the carriage speed never exceeds normal free lift speed by more than a negligible degree during mast extension, and never appoaches 150% or more of normal free lift speed as would otherwise be the case if previous, hydraulically sequenced or constant speed highvisibility ram assemblies were used.

The minimizing of the space required for the additional mast section, additional set of lifting chains and additional hydraulic conduits required in a four-stage mast, so as to maximize both visibility and load-carrying capacity of the lift truck, is accomplished by a particular staggered nesting relationship of the mast sections with one another such that the inner intermediate and outer mast sections are in more rearwardly positions than the inner and outer intermediate mast sections. This in turn permits lift chain connections for the two sets of mast extension chains to extend transversely both inwardly and outwardly from the inner intermediate mast section in an exceptionally compact manner made possible by the rearward location of the inner intermediate mast section. Such structure, in combination with the orientation of the two sets of mast extension lift chains perpendicularly to each other enables the location of these lift chains in positions not requiring any extra forward or transverse space nor interfering with visibility.

Moreover, the hydraulic conduit supplying pressurized fluid to the ram assembly is interfaced functionally with one mast extension chain set and structurally with the other mast extension chain set in a configuration presenting no interference with visibility and requiring no hose reels or extra space despite the fact that the base of the ram assembly, which is supplied by the conduit, is mounted on the inner intermediate, or tertiary, mast section and therefore extends with the mast assembly to a relatively high elevation.

The foregoing and other objectives, features and advantages of the present invention will be more readily understood upon consideration of the following detailed description of the invention taken in conjunction with the accompanying drawings.

DETAILED DESCRIPTION OF THE PREFERRED EMBODIMENT

STRUCTURE

Figure 1:
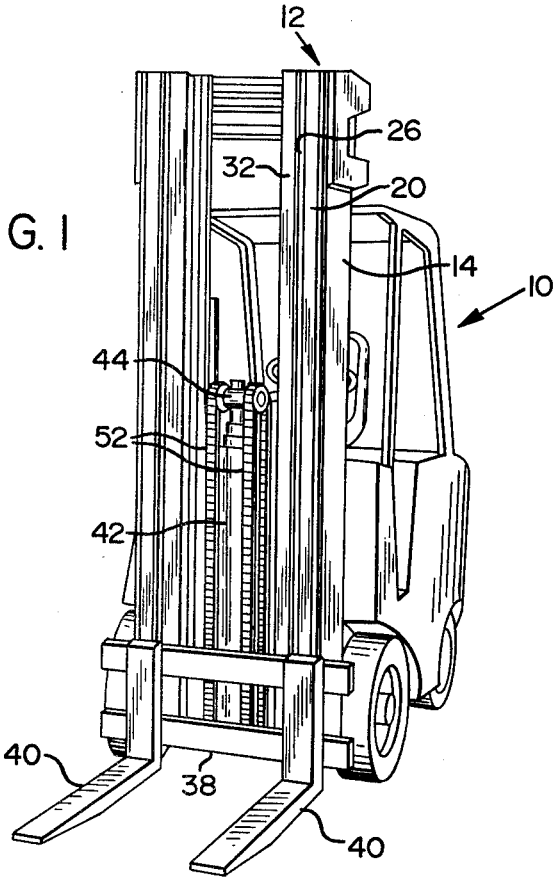
FIG. 1 is a perspective view of a lift truck showing a mast constructed in accordance with the present invention mounted thereon.
Figure 8:
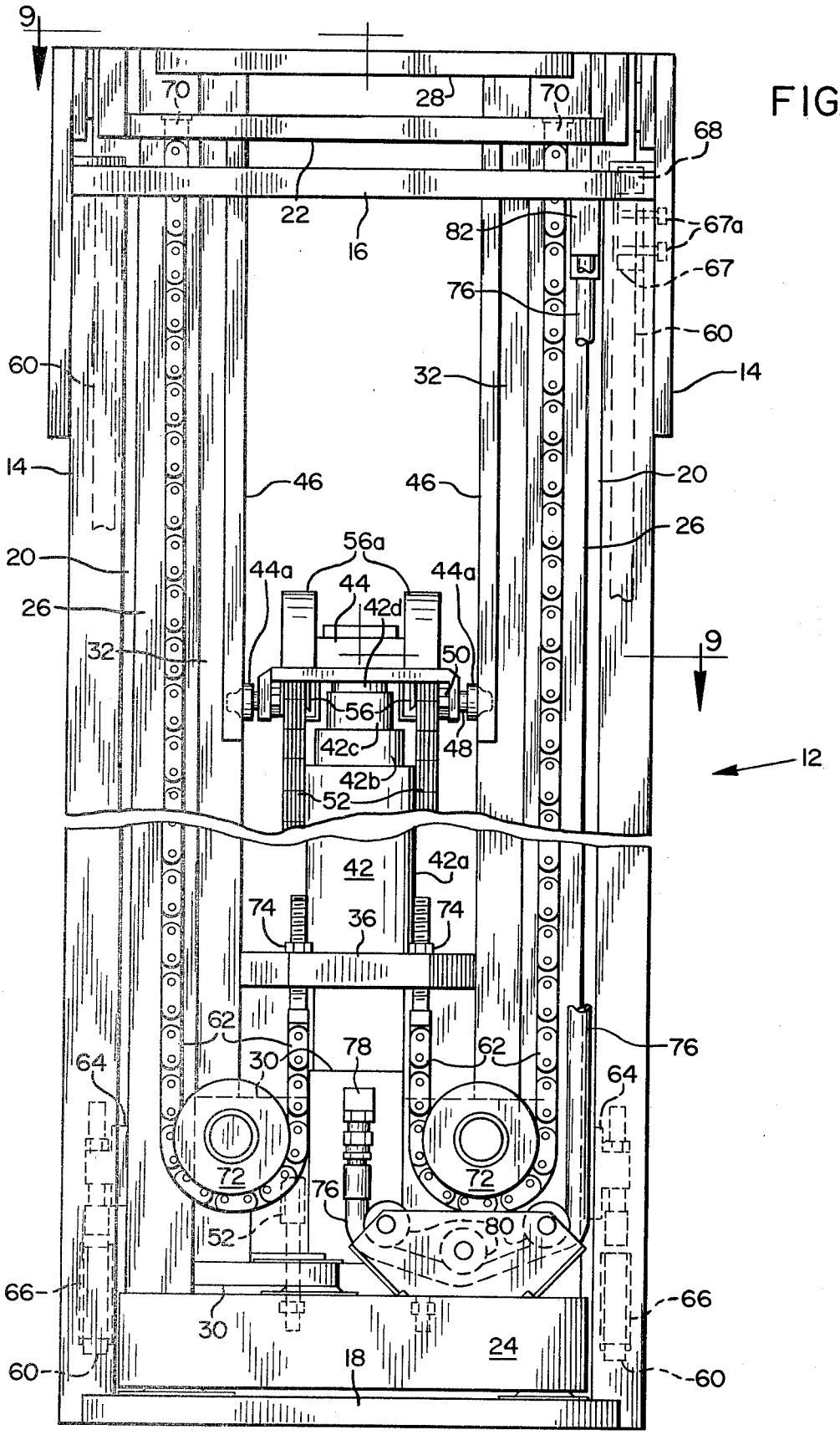
FIG. 8 is a simplified extended rear view of a four-stage mast constructed in accordance with the present invention.
Figure 9:
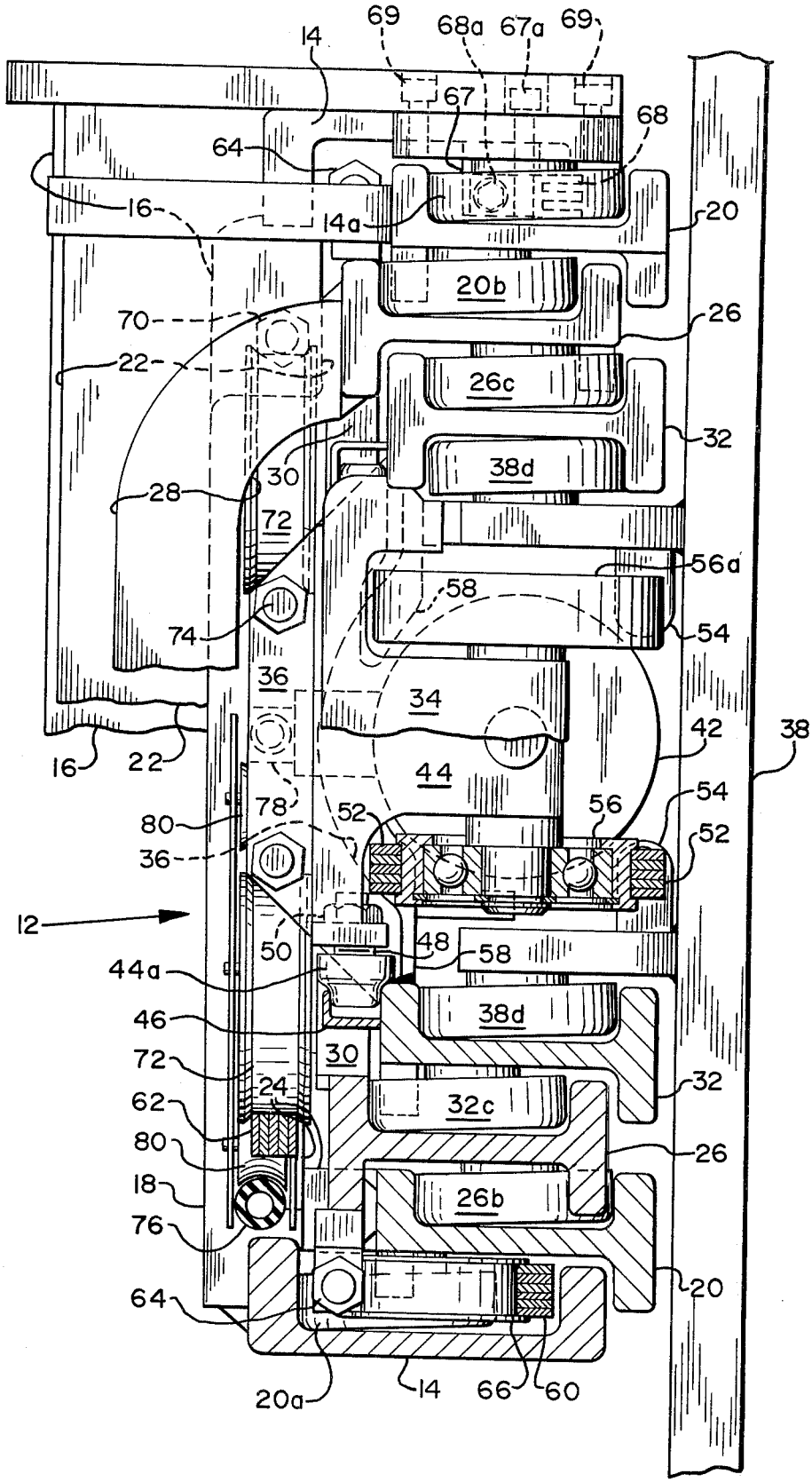
FIG. 9 is a partially sectional view taken along line 9—9 of FIG. 8.

FIG. 1 depicts a lift truck, generally indicated as 10, having a four-stage extensible contractible telescopic mast 12 constructed in accordance with the present invention mounted on the front thereof. With reference also to FIGS. 8 and 9, the mast 12 consists of multiple relatively reciprocable mast sections comprising an outer mast composed of a pair of transversely-spaced, inwardly-facing upright channel members 14 joined together at their tops by a cross member 16 and at their bottoms by a cross member 18. Spaced transversely inwardly from the upright members 14 are a pair of I-beam-shaped upright members 20 interconnected by a cross member 22 at their tops and by a cross member 24 at their bottoms which form the outer intermediate mast section. An outwardly-facing bottom roller 20*a* (FIG. 9) is rotatably mounted upon each of the upright members 20 of the outer intermediate mast section, extending through a cutout in one of the rear flanges of each of the upright members 20 and engaging a rear, inwardly-extending flange of a respective channel-shaped outer mast upright member 14. Also, an inwardly-facing top roller 14*a* is rotatably mounted upon each of the outer mast upright members 14 and engages a rear flange of a respective one of the upright members 20. These rollers permit longitudinal extension of the outer intermediate mast section with respect to the outer mast section while also resisting the normal bending moments imposed on the mast by the load.

An inner intermediate mast section composed of I-beam-shaped upright members 26 interconnected at their tops by cross member 28, and at their bottoms by cross member 30, is positioned between the upright members 20 of the outer intermediate mast section. An outwardly-facing bottom roller 26*b* rotatably mounted to each upright member 26 engages a rear flange of an upright member 20, while an inwardly-facing top roller 20*b* rotatably mounted upon each upright member 20 engages a rear flange of a respective upright member 26 to permit longitudinal extension of the inner intermediate mast section with respect to the outer intermediate mast section in a manner similar to that previously described with respect to rollers 14*a* and 20*a*.

Mounted transversely between the upright members 26 of the inner intermediate mast section is the inner mast section composed of a pair of I-beam-shaped upright members 32 joined together at their tops by an upper cross member 34 (FIG. 9) and at their bottoms by a lower cross member 36. Each upright member 32 of the inner mast section has an outwardly-facing bottom roller 32*c* mounted rotatably thereon which, in cooperation with a respective inwardly-facing top roller 26*c* mounted upon each upright member 26 of the inner intermediate mast section, permits longitudinal movement of the inner mast section with respect to the inner intermediate mast section in a manner similar to that described with respect to cooperating rollers 14*a* and 20*a*.

Mounted upon the upright members 32 of the inner mast section for vertical movement with respect thereto is a load carriage 38 having upper and lower transversely spaced pairs of rollers 38*d* respectively engaging the inwardly-facing channels of the upright members 32. The load carriage 38 extends forwardly from the inner mast section and has load-handling implements such as forks 40 (FIG. 1), clamp arms or similar load-handling devices mounted thereon.

A fluid-actuated, extensible-contractible fluid ram assembly 42 has a base portion 42*a* supportably mounted upon the lower cross member 30 of the inner intermediate mast section such that the ram assembly 42 moves in unison therewith. Three relatively reciprocable ram portions 42*b*, 42*c* and 42*d* respectively are extensible from the base portion 42*a*, the ram portion 42*d* having an upper end terminating in a cross head 44 which is more extensible in a longitudinal direction than the upper ends of the other ram portions 42*b* and 42*c*. The cross head 44 is longitudinally movable and guidable with respect to the upright members 32 of the inner mast section by means of transversely-spaced rollers 44*a* which ride vertically in inwardly-facing longitudinal channels 46 mounted on the upright members 32. Each roller 44*a* includes an outer portion of relatively small diameter which rides matingly within a respective channel 46, thereby providing fore-and-aft guidance to the cross head 44, and a portion of relatively larger diameter, separated by a shoulder from the smaller diameter portion, which engages the inwardly-facing ends of the channel 46 and thereby provides transverse guidance to the cross head 44. Each roller 44*a* is rotatably mounted to the cross head 44 on a shaft 48 which is threaded into the cross head 44, thereby permitting transverse adjustment of the rollers 44*a* toward, or away from, one another to permit high-tolerance transverse adjustment of the cross head position. A lock nut 50 retains each threaded shaft 48 in its adjusted position.

It will be noted that the ram assembly 42, in its fully contracted position as best seen in FIG. 1, positions the cross head 44 at a position located nearer to the longitudinal midpoint of the fully contracted mast than to the extensible end, or top, thereof. It is preferable that the cross head 44 be substantially no higher than the longitudinal midpoint of the fully contracted mast, as shown in FIG. 1, to permit the lift truck operator an unobstructed line of vision through the space between the pairs of upright members when transporting a load in the nearly fully-lowered position of the load carriage 38.

Elevation of the load carriage and extension of the mast assembly, the operation of which will be described hereafter in greater detail, are accomplished through the extension of the ram assembly 42 and the cooperation of three pairs or sets of load-lifting flexible tension members, usually chains. One pair of chains 52, hereinafter referred to as the free lift chains, are visible in FIG. 1 and in greater detail in FIGS. 8 and 9. Each chain 52 is connected at one end to a respective chain anchor 54 on the carriage 38 from which it extends upwardly and is trained over one of a respective pair of sheaves 56 rotatably mounted on the cross head 44, and then extends downwardly toward a respective chain anchor 58 (FIG. 9) fixedly attached to a respective one of the inner mast section upright members 32 adjacent its bottom. Respective housings 56*a* surround the upper portions of the sheaves 56 providing protection therefor. The chain anchors 58 are located forwardly of the lower cross member 30 of the inner intermediate mast section so as not to interfere therewith during reciprocation of the inner mast section with respect to the inner intermediate mast section.

Two further pairs of load-lifting chains 60 and 62 respectively are provided, pair 60 serving to extend the outer intermediate mast section with respect to the outer mast section, and pair 62 serving to extend the inner intermediate mast section with respect to the outer intermediate mast section. In discussing the interconnection of the two pairs of chains 60 and 62 respectively with the various mast sections, it should be noted that the front and rear elongate edges of the inner intermediate mast section and outer mast section respectively are located more rearwardly than the corresponding edges of the outer intermediate and inner mast sections respectively as best seen in FIG. 9, thereby defining elongate rear portions of the inner intermediate mast section and outer mast section which protrude rearwardly of the corresponding portions of the outer intermediate and inner mast sections respectively. This structure serves the dual purposes of minimizing the fore-and-aft dimension of the mast, thereby minimizing forward extension of the load and thereby increasing load capacity, and also enabling the placement and attachment of the pairs of chains 60 and 62 respectively such as to require a minimum of space and present no interference with visibility. More particularly, this structure permits the pair of chains 60 to be placed transversely outwardly of the inner intermediate mast section and to be interconnected therewith by a connection which extends transversely behind the outer intermediate mast section while, at the same time, the pair of chains 62 may be placed transversely inwardly of the inner intermediate mast section and interconnected therewith by a connection which extends transversely behind the inner mast section. This permits effective utilization of all of the rearward spaces provided by the alternating fore-and-aft staggered nesting of the mast sections, and thereby obviates the need for additional space which would normally be required for accommodating the two pairs of chains 60 and 62.

With reference particularly to FIGS. 8 and 9, it will be seen that each chain 60 is connected to the rearwardly protruding rear portion of one of the respective upright members 26 of the inner intermediate mast section by a transversely-extending chain anchor 64 which extends from the bottom of the respective upright member 26 outwardly toward the outer upright member 14 bypassing the rear edge of the upright member 20. One end of each chain 60 depends from a respective chain anchor 64 and is trained beneath a respective sheave 66 rotatably mounted on each upright member 20 of the outer intermediate mast section so as to rotate about a transverse axis. From the respective sheave 66, each chain 60 extends upwardly through an elongate enclosure formed between the upright members 14 and 20 respectively bounded longitudinally by the transversely-extending strengthening flanges of the respective upright members. Each chain 60 ultimately connects to an upright member 14 of the outer mast section at an upper chain anchor 68 (FIG. 9) fixed to the interior of the respective upright member 14 adjacent its top.

Each chain anchor 68 includes a detachment structure, such as bolt 68*a*, which is operatively accessible while the anchor is within the enclosure for permitting detachment of the end of the chain from the upright member 14 despite the location of the anchor and chain within the enclosure. This facilitates removal of the chain for servicing or replacement without requiring disassembly of the mast. Access to the bolt 68*a* through the top of the enclosure is provided by a removable mounting of the respective roller 14*a*, located above the chain anchor 68, comprising roller bolts 69 which detachably mount the roller 14*a* to the respective upright member 14. Interference blocks 67, upon which each chain anchor 68 is detachably mounted, are also provided for preventing hyperextension of the outer intermediate mast section with respect to the outer mast section by limiting the upward travel of a respective sheave 66. Each interference block 67 is also removable by bolts 67*a* which are accessible from the exterior of the mast to permit assembly and disassembly of the mast sections.

Each of the other pair of chains 62 has one of its ends connected to the upper cross member 22 of the outer intermediate mast section at a respective chain anchor 70 from which it depends downwardly and is trained beneath a respective rearwardly-facing sheave 72 rotatably mounted on the lower cross member 30 extending transversely between the rear portions of the upright members 26 of the inner intermediate mast section so as to rotate about an axis extending from front to rear. From the sheave 72 the respective chain 62 extends upwardly to a respective chain anchor 74 connected to the cross member 36 of the inner mast section. Thus it is apparent that the rearward position of the upright members 26 of the inner intermediate mast section provide both outwardly-extending and inwardly-extending transverse chain connections which occupy both spaces behind the forwardly-positioned upright members 20 and 32 respectively and require no additional space. Moreover this structure enables the placement of one pair of chains, i.e. chains 60, in an enclosure between the outer and outer intermediate mast sections which is otherwise unusable for any purpose while enabling the placement of the second set of chains, i.e. chains 62, in positions behind other, already-existing structural elements (i.e. behind upright members 26 and chains 52 respectively) thereby preventing any interference with visibility.

Inasmuch as the base portion 42*a* of the ram assembly is mounted on the inner intermediate mast section and thereby moves upwardly in unison therewith during mast extension, a fluid conduit for introducing fluid under pressure into the ram assembly, extensible with the inner intermediate mast section and base portion of the ram assembly, must be provided. In the present structure this also is accomplished without requiring additional space nor interfering with operator visibility by means of a flexible hydraulic conduit 76 connected at one end by a fitting 78 to the base portion 42*a* of the ram assembly and depending therefrom to a series of transversely-spaced sheaves 80 mounted on the lower cross member 24 of the outer intermediate mast section so as to rotate about axes extending from front to rear. The conduit 76 is trained under the sheaves 80 from which it extends upwardly toward the upper cross member 16 of the outer mast section to which it is attached by a bracket 82. From its point of attachment to the cross member 16, it depends downwardly toward the lift truck 10 where it is coupled in a conventional manner to the lift truck's hydraulic system (not shown). The training of the hydraulic conduit 76 under, rather than over, the sheaves 80, permits placement of the sheaves 80 in an exceptionally low position far beneath where they might otherwise obstruct operator vision in the lowered position of the load carriage. Moreover, the orientation of the sheaves 80 so as to rotate about axes extending from front to rear makes it possible to nest the conduit 76 structurally with one of the chains 62 which likewise is trained beneath a sheave 72 which rotates about an axis extending from front to rear. Because the conduit 76 is generally not adapted to be bent in as tight a 180° turn as is a chain such as 62, the sheaves 80 are mounted beneath a respective one of the sheaves 72 as seen in FIG. 8 with the respective chain 62 and conduit 76 being located in substantially parallel, side-by-side relation to each other when the mast is fully contracted. It should be noted that this parallel, side-by-side relation of conduit to chain is adaptable either to a situation where the chain sheave 72 and conduit sheaves 80 are rotatably mounted on the same mast section or, as in the present case, where the conduit sheaves 80 are rotatably mounted on a lower mast section than is the chain sheave 72.

Figure 5:
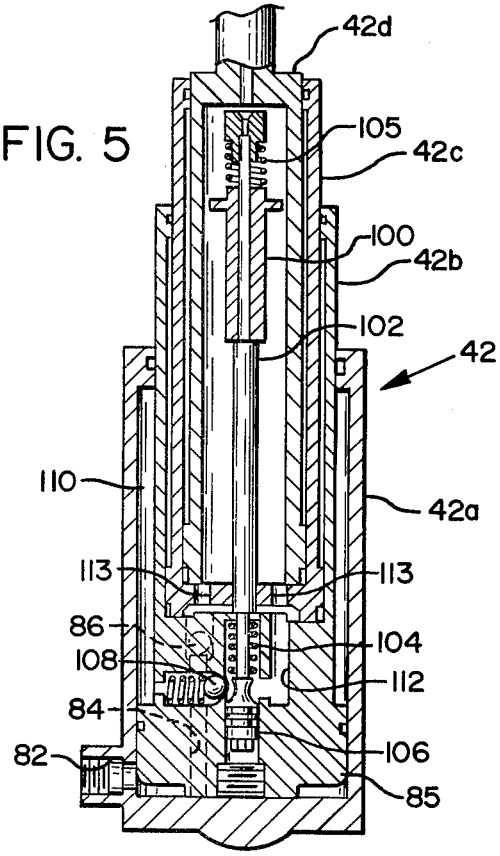
FIGS. 5 and 6 are simplified cross sections of the ram assembly utilized in the present invention.
Figure 6:
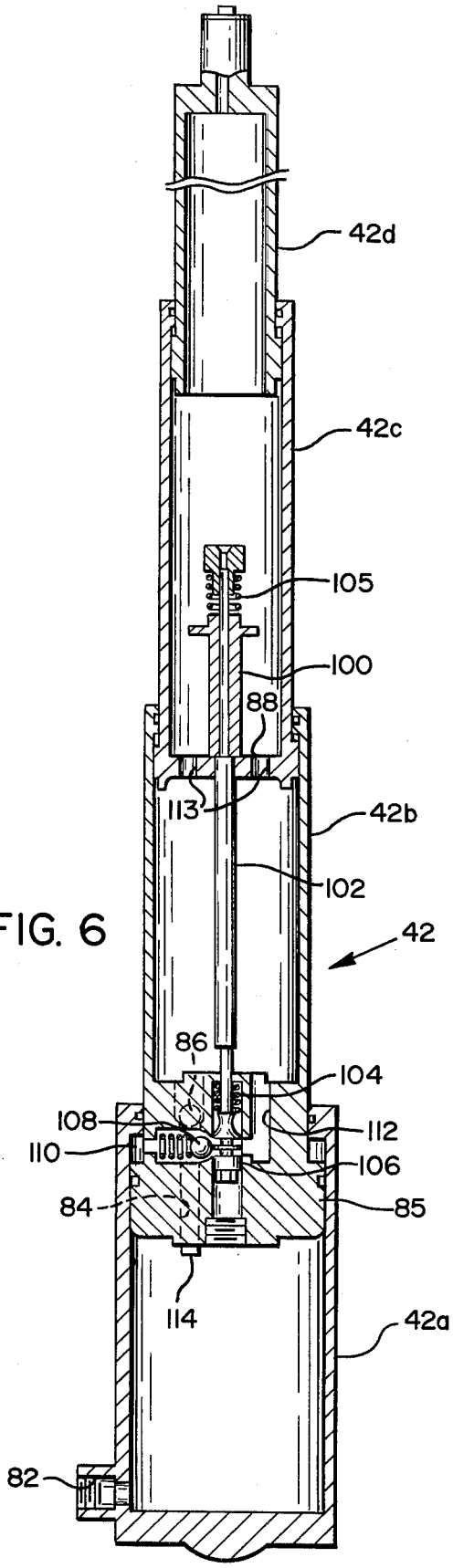

The internal structure of the preferred ram assembly 42 is shown in simplified form in FIGS. 5 and 6. The ram assembly 42 is initially extended from its fully contracted position as depicted in FIG. 5 by the introduction of fluid under pressure through an entry port 82 into the base portion 42*a* from which it flows through passageway 84 in piston head 85 past one-way ball valve 86 to the working surface area of ram portion 42*c*, thereby causing ram portion 42*c* to extend from ram portion 42*b* in unison with ram portion 42*d* which is carried within portion 42*c*. As ram portion 42*c* reaches it full extensibility, its inner bottom surface 88 contacts and lifts tube 100 slidably mounted on rod 102, the latter being spring-biased to a lowered position by spring 104. Tube 100 compresses spring 105 which raises rod 102 and valve unseating member 106 contained within piston head 85, which unseats one-way ball valve 108 and permits fluid trapped in the cavity 110 above the piston head 85 to escape through check valve 108, past the peripheral grooves in unseating member 106 and through passageway 112. This escape of fluid from cavity 110 in turn permits the extension of ram portion 42*b* from base portion 42*a*. As ram portion 42*b* begins to extend, a tube 114 slidably contained within the piston head 85 is permitted to drop down by gravity, seating ball valve 86 and preventing the exhaust through passageway 84 of fluid escaping from cavity 110, such fluid thereby being applied under pressure through passageways 113 in the bottom of ram portion 42*c* to the working surface area of ram portion 42*d*. Thus ram portion 42*d* extends from ram portion 42*c* simultaneously with the extension of ram portion 42*b* from base portion 42*a*. Upon retraction of the ram assembly 42, the reverse sequence occurs. The specific additional features of the preferred ram assembly 42 which cooperate with the remainder of the mast 12 to achieve substantially uniform load carriage lifting speed throughout its range of travel will be described in the following discussion regarding operation of the mast.

OPERATION

Figure 7:
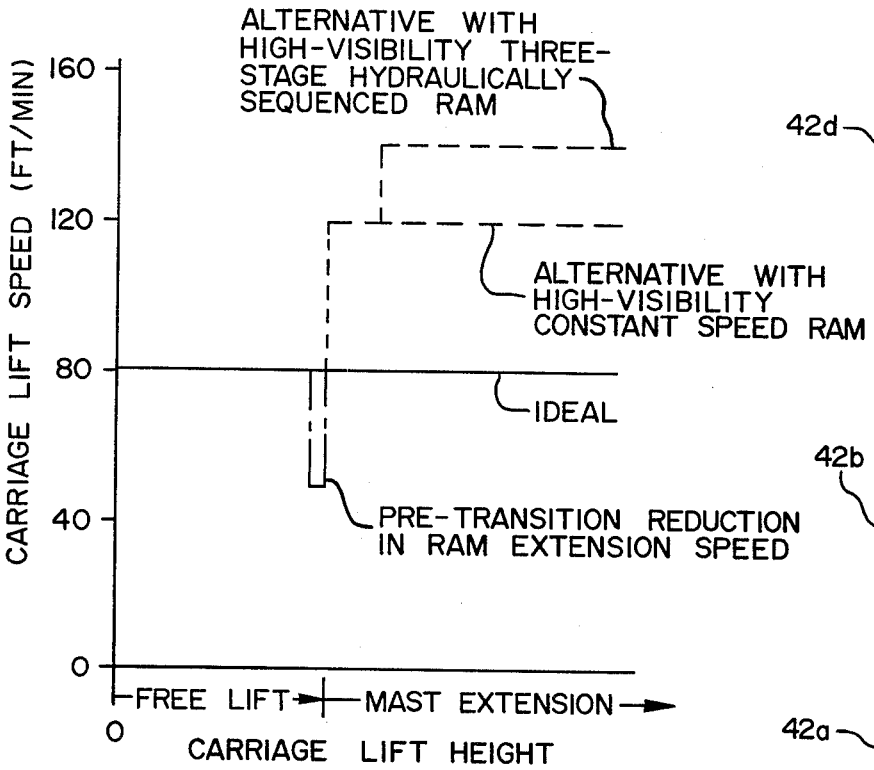
FIG. 7 is a graph comparing carriage lift speeds at different carriage lift heights achievable with the present invention to corresponding carriage lift speeds in alternative high-visibility constructions.
Figure 2:
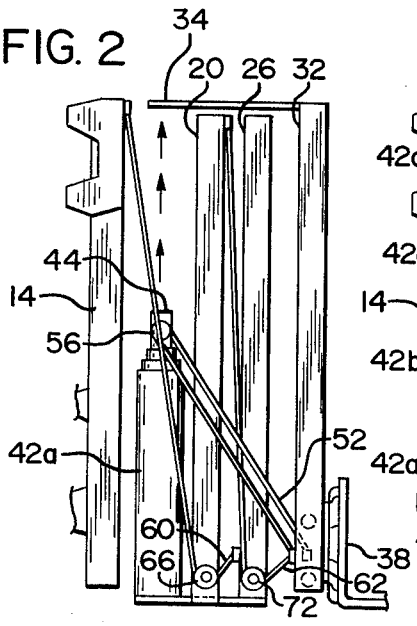
FIGS. 2–4 are simplified, schematic drawings showing sequential extension of a four-stage mast constructed in accordance with the present invention.
Figure 3:
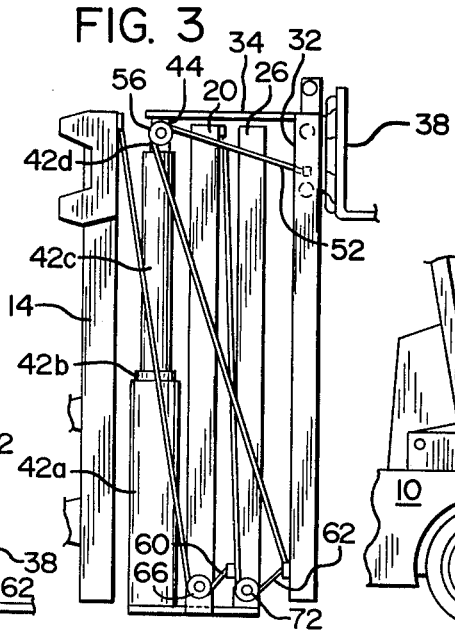
Figure 4:
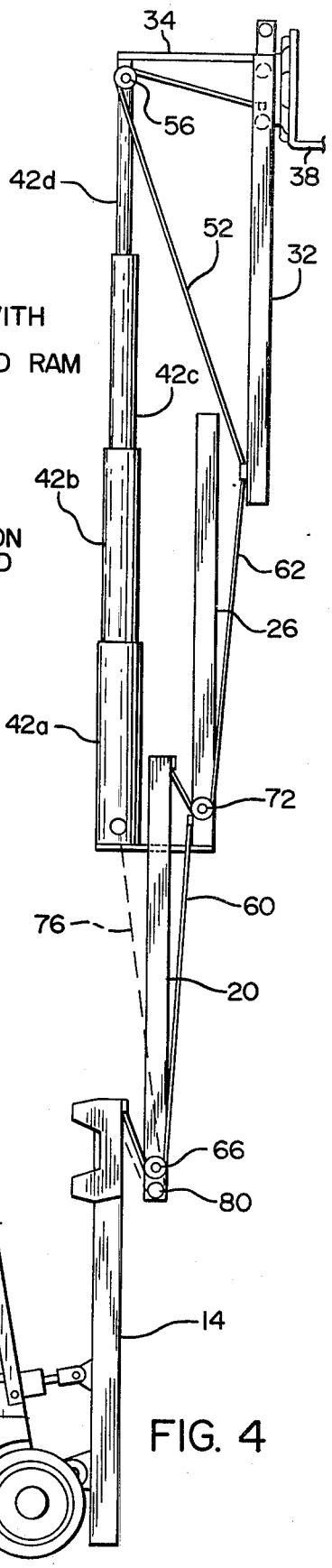

The sequential operation of the mast assembly 12 of the present invention is depicted by FIGS. 2, 3 and 4 and graphically by FIG. 7. FIG. 2 depicts the fully-contracted condition of the mast sections and the ram assembly, wherein the load carriage 38 is fully lowered. In the traveling or transporting condition of the mast assembly, wherein lift truck operator visibility is critical, the mast and ram assembly are also substantially in their fully contracted conditions as shown in FIG. 2, cross head 44, constituting the most extensible end of the ram assembly, being only slightly elevated sufficiently so that some minimal clearance exists between the load carriage 38 and the ground. It will be noted that the top of the cross head 44, in the fully-contracted position of the ram assembly as shown in FIG. 2 is located nearer to the longitudinal midpoint of the fully contracted mast than to the extensible end or top of the fully contracted mast, and is preferably positioned no higher than such midpoint for maximum operator visibility.

Upon the introduction of pressurized fluid into the ram assembly, ram portion 42*c* begins extending with ram portion 42*d* contained therein. This initiates the initial, or free lift, portion of upward travel of load carriage 38 whereby the chains 52 lift the load carriage 38 at a speed which is twice the speed of extension of cross head 44 on the extensible end of the ram assembly. Ram portion 42*b* meanwhile, although having a much larger working surface area than ram portion 42*c*, remains fully contracted within base portion 42*a* because ball valve 108 prevents the escape of fluid from cavity 110 on the upper side of the piston head 85 of ram portion 42*b*. Ram portion 42*d* on the other hand does not extend from ram portion 42*c* during this same period because its working surface area is smaller than that of ram portion 42*c* and a higher pressure than that required to extend ram portion 42*c* would be required to cause ram portion 42*d* to extend from ram portion 42*c*.

The initial, or free lift portion of load carriage elevation continues until the load carriage and ram assembly reach positions as shown in FIG. 3. At this point the load carriage 38 has reached substantially the top of the inner mast section, and cross head 44 has contacted cross member 34 of the inner mast section. This condition represents the transition point from the initial free lift portion of load carriage travel to the latter, or mast extension, portion of upward carriage travel. From this point further extension of the ram assembly causes the simultanous extension of each mast section, except for the outer mast section, from the next lower mast section by the action of chains 60 and 62. Thus, by virtue of the contact between the cross head 44 and the cross member 34 of the inner mast section, the ram assembly extends the inner mast upright members 32 from the inner intermediate mast upright members 26. This extension in turn exerts tension on chains 62 which exert a lifting force on the inner intermediate upright members 26 through sheaves 72 and extend the inner intermediate upright members 26 from the outer intermediate upright members 20. The latter extension in turn exerts tension on chains 60 which exert a lifting force on outer intermediate upright members 20 through sheaves 66, thereby extending outer intermediate uprights members 20 from outer upright members 14. The result of the foregoing simultaneous extensions of the mast sections is that the speed of upward carriage travel during this latter, mast extension, portion of carriage travel is three times the speed of extension of the ram assembly, i.e. the upward speed of the cross head 44 relative to the base portion 42*a*, the latter being simultaneously elevated in unison with the inner intermediate mast section. The mast extension portion of carriage travel continues until the fully-extended condition of the mast assembly, as represented by FIG. 4, is reached.

With reference to FIG. 7, the comparative possible effects upon load carriage speed of the transition from the initial free lift portion of carriage travel, at a two-to-one ratio of carriage speed to ram extension speed, to the latter or mast extension portion of carriage travel, at a three-to-one ratio of carriage to mast extension speed, are depicted. If a three-stage ram assembly of the type shown in the above-mentioned Quayle patents, having a relatively low contracted height (i.e. two-thirds of the contracted mast height), were utilized in order to provide good operator visibility, the speed of upward travel of the load carriage 38 would increase to 150% of free lift speed at the transition point between free lift and mast extension and, slightly later when the third stage of the ram assembly began to extend, would increase even further assuming a constant volumetric flow of hydraulic fluid supplied to the ram assembly. Alternatively, if a low collapsed height constant-speed ram were utilized, upward load carriage speed would increase to exactly 150% of free lift speed at the transition point between free lift and mast extension due to the difference between the two-to-one and three-to-one lifting ratios provided by the chains 52, 60 and 62 respectively.

In contrast, the present invention provides an arrangement adapted to utilize a low collapsed height ram which reduces the speed of extension of the ram assembly (assuming a constant volumetric flow of hydraulic fluid into the ram assembly) at the transition point to compensate for the increase in ratio between carriage and ram assembly speeds at the transition point. The timing of such reduction in ram extension speed cannot, however, be dependent upon any substantial change in the pressure of the hydraulic fluid in the ram assembly as is conventional with ram assemblies which utilize hydraulic sequencing to change extension speed, since such pressure change will always be accompanied by a substantial change in load carriage speed by virtue of the change in mechanical advantage or disadvantage which causes the pressure change. In other words, a change in carriage speed is always required in order for hydraulic sequencing to operate properly, and a substantial change is required for such sequencing to operate reliably under changing conditions of friction and the like.

The present invention reduces ram extension speed during the latter, or mast extension, portion of upward carriage travel while eliminating any dependence upon substantial changes in hydraulic pressure or overall mechanical advantage or disadvantage to provide proper sequencing or timing of the reduction in ram extension speed. This enables the accomplishment of the ideal result of substantially uniform carriage speed during its entire range of travel, or at least a carriage speed during mast extension which differs, if at all, by less than 50% from free lift carriage speed, and is much nearer to free lift carriage speed than would be the case if hydraulic sequencing were utilized. The foregoing result is accomplished by enlargement of the effective working surface at the bottom of piston head 85 of ram portion 42*b* to an area considerably more than twice that of the effective working surface of ram portion 42*c*, and preferably to substantially three times that of ram portion 42*c*. By adjustment of the wall thicknesses of ram portions 42*b* and 42*c*, the effective working area on the top of piston head 85 (i.e. at the bottom of cavity 110) can be made substantially equal to the effective working area of ram portion 42*d* such that ram portion 42*d* will extend from ram portion 42*c* under the pressure of fluid escaping from cavity 110 simultaneously with, and at the same speed as, the extension of ram portion 42*b*, from base portion 42*a*. With the effective working surface of piston head 85 of ram portion 42*b* at substantially three times that of ram portion 42*c*, ram portion 42*b* extends from base portion 42*a* during mast extension at substantially one-third the speed at which ram portion 42*c* previously extended from ram portion 42*b* during the initial free lift portion of carriage travel. The corresponding simultaneous extension of ram portion 42*d* at the same speed as ram portion 42*b* results in an overall speed of extension of the ram assembly 42, during the mast extension portion of carriage travel, which is two-thirds the speed of ram extension during the free lift portion of carriage travel. Thus the relationship between the respective speeds of extension of the ram assembly during the initial and latter portions of upward carriage travel can be made substantially inversely proportional (i.e. 3 to 2) to the relationship between the corresponding ratios of load carriage speed to speed of extension of the ram assembly (i.e. 2 to 3). This provides substantially uniform carriage speed throughout its entire range of travel, which is a substantial improvement over the alternative results obtainable with hydraulically-sequenced ram assemblies or constant speed ram assemblies, both of which would require a substantial increase in carriage speed during the latter, mast extension portion of upward carriage travel. With the present arrangement it is possible to achieve the ideal uniformity of carriage speed throughout its range of travel represented by the solid line of the graph of FIG. 7, or as near thereto as is deemed satisfactory.

From a practical point of view, it may be somewhat difficult mechanically to reliably time the reduction in ram extension speed to coincide with the transition point between free lift and mast extension. For example, although such timing could be accomplished within close tolerance when the mast is initially manufactured, subsequent servicing of the mast, replacement and adjustment of chains and the like could defeat the desired coincidence of timing. In anticipation of this possible problem, it has been determined that reduction in ram extension speed after the transition point between free lift and mast extension would be far less acceptable than reduction in ram extension speed before the transition point because the former would result in a momentary increase of 50% in both carriage speed and hydraulic pressure, adversely affecting load control and causing a harmful pressure surge in the hydraulic system. In contradistinction, reducing ram extension speed prior to the transition point merely causes a momentary reduction of 33% of normal carriage speed and no potentially harmful pressure surge as illustrated in FIG. 7. Accordingly the ram assembly is preferably mounted at a height relative to the upright sections so as to reduce its speed of extension slightly before cross head 44 contacts cross member 34 during elevation of the carriage.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A load-lifting structure for an industrial lift truck or the like comprising:

(a) an extensible contractible, four-section telescopic mast having elongate, transversely-spaced outer, outer intermediate, inner intermediate and inner mast sections, each of said mast sections having front and rear elongate edges respectively, the front and rear elongate edges of said inner intermediate mast section being located more rearwardly than the corresponding edges of said outer intermediate and inner mast sections positioned on either side thereof, thereby defining an elongate rear portion of said inner intermediate mast section which protrudes rearwardly of the corresponding portions of the outer intermediate and inner mast sections respectively;

(b) a load carriage movably mounted upon said inner mast section and extending forwardly therefrom for vertical movement with respect thereto;

(c) a first flexible tension member for extending said outer intermediate mast section with respect to said outer section and a second flexible tension member for extending said inner intermediate mast section with respect to said outer intermediate mast section; and (d) first means interconnecting said first flexible tension member with said elongate rear portion of said inner intermediate mast section and extending from said rear portion transversely behind the rear elongate edge of said outer intermediate mast section toward said outer mast section, and second means interconnecting said second flexible tension member with said elongate rear portion of said inner intermediate mast section and extending from said rear portion transversely behind the rear elongate edge of said inner mast section in a transverse direction opposite to that of said first means.

2. The load-lifting structure of claim 1 including a first sheave mounted on said outer intermediate mast section between said outer mast section and said outer intermediate mast section so as to rotate about a transverse axis, said first flexible tension member being trained about said first sheave and having one end connected by said first means to said elongate rear portion of said inner intermediate mast section and the other end connected to said outer mast section, said second means comprising a second sheave rotatably mounted on said elongate rear portion of said inner intermediate mast section so as to rotate about an axis extending from front to rear perpendicularly to the axis of said first sheave, said second flexible tension member being trained about said second sheave and having one end connected to said outer intermediate mast section and the other end connected to said inner mast section.

3. The load-lifting structure of claim 2 wherein the front and rear elongate edges respectively of said outer mast section are located more rearwardly than the corresponding edges of said outer intermediate and inner mast sections.

4. The load-lifting structure of claim 3 wherein said outer mast section and outer intermediate mast section have elongate, transversely-extending flange means for strengthening said mast sections, said flange means defining an elongate enclosure between said outer and outer intermediate mast sections bounded longitudinally by said flange means, said first flexible tension member extending longitudinally through said enclosure.

5. A load-lifting structure for an industrial lift truck or the like comprising:

(a) an extensible-contractible, telescopic mast having elongate, transversely-spaced first, second, third and fourth relatively reciprocable mast sections respectively, said second section being extensible from said first section, said third section being extensible from said second section and said fourth section being extensible from said third section;

(b) a fluid-actuated, extensible-contractible fluid ram assembly comprising a base portion and an extensible ram portion reciprocable with respect to said base portion, said base portion being mounted upon said third mast section for movement in unison therewith;

(c) a first sheave mounted on said second mast section adjacent the bottom thereof so as to rotate about an axis extending from front to rear;

(d) a flexible hydraulic conduit trained under said first sheave and having one end connected to said base portion of said ram assembly and the other end connected to said first mast section adjacent the top thereof for introducing fluid under pressure into said ram assembly;

(e) a second sheave rotatably mounted on said third mast section so as to rotate about an axis extending from front to rear; and (f) a flexible tension member trained under said second sheave and having one end connected to said second mast section and the other end connected to said fourth mast section, said second sheave being positioned above said first sheave and said flexible tension member and flexible hydraulic conduit respectively being located in substantially parallel, side-by-side relation to each other when said telescopic mast is fully contracted.

6. A load-lifting structure for an industrial lift truck or the like comprising:

(a) an extensible-contractible telescopic mast having first, second, third and fourth relatively reciprocable mast sections respectively and an extensible end, said second section being extensible from said first section, said third section being extensible from said second section and said fourth section being extensible from said third section;

(b) a load carriage movably mounted upon said mast for upward movement through a predetermined range of upward carriage travel;

(c) a fluid-actuated, extensible-contractible fluid ram assembly comprising a base portion mounted upon said third mast section for movement in unison therewith and first, second and third relatively reciprocable elongate ram portions extensibly mounted with respect to said base portion for extending and thereby moving said load carriage upwardly in response to the introduction of fluid under pressure into said ram assembly, the first one of said ram portions having an extensible end which is more extensible in a longitudinal direction than any other of said ram portions, the extensible end of said first ram portion being located nearer to the longitudinal midpoint of said mast than to the extensible end of said mast when said mast and ram assembly are fully contracted;

(d) means operatively interconnecting said mast, load carriage and ram assembly for moving said carriage upwardly, in response to introduction of fluid under pressure into said ram assembly, at predetermined ratios of the speed of said load carriage to the speed of extension of said ram assembly, the predetermined ratio thereof being less during an initial portion of said upward carriage travel than during a latter portion of said upward carriage travel;

(e) means within said ram assembly for extending said ram assembly, when fluid under pressure is introduced thereinto at a substantially constant rate, at a first speed of extension during said initial portion of said upward carriage travel by simultaneously extending said first and second ram portions as a unit during initial extension of the ram assembly from a fully-contracted state and, thereafter during said latter portion of said upard carriage travel, at a second speed of extension less than said first speed of extension by simultaneously extending said first and third ram portions relative to said second ram portion and said base portion respectively.

7. A load-lifting structure for an industrial lift truck or the like comprising:

(a) an extensible-contractible telescopic mast having first, second, third and fourth mast sections respectively and an extensible end, said second section being extensible from said first section, said third section being extensible from said second section and said fourth section being extensible from said third section;

(b) a load carriage movably mounted upon said mast for upward movement through a predetermined range of upward carriage travel;

(c) a single fluid-actuated, extensible-contractible fluid ram assembly comprising a base portion mounted upon said third mast section for movement in unison therewith and first, second and third relatively reciprocable elongate ram portions extensibly mounted with respect to said base portion for moving said load carriage upwardly and extending said mast in response to the introduction of fluid under pressure into said ram assembly, the first one of said ram portions having an extensible end which is more extensible in the longitudinal direction than any other of said ram portions, the extensible end of said first ram portion being located nearer to the longitudinal midpoint of said mast than to the extensible end of said mast when said mast and ram assembly are fully contracted; and (d) means associated with said mast, load carriage and ram assembly for moving said carriage upwardly, when fluid under pressure is introduced into said ram assembly at a substantially constant rate, at respective speeds during initial and latter portions respecitvely of said range of upward carriage travel which differ, if at all, from each other by less than 50% of said speed during said initial portion of said range of upward carriage travel, said latter portion of said range of upward carriage travel occurring simultaneously with extension of said mast, said means including means for causing, when fluid under pressure is introduced into said ram assembly at a substantially constant rate, extension of said ram assembly at a first speed of extension by simultaneously extending said first and second ram portions as a unit during initial extension of the ram from a fully-contracted state, and thereafter extension of said ram assembly at a second speed of extension less than said first speed of extension by simultaneously extending said first and third ram portions relative to said second ram portion and said base portion respectively.

8. A load-lifting structure for an industrial lift truck or the like comprising;

(a) an extensible-contractible telescopic mast having first, second, third and fourth relatively reciprocable mast sections respectively and an extensible end, said second section being extensible from said first section, said third section being extensible from said second section and said fourth section being extensible from said third section;

(b) a load carriage movably mounted upon said mast for upward movement through a predetermined range of upward carriage travel;

(c) a fluid-actuated, extensible-contractible fluid ram assembly comprising a base portion mounted upon said third mast section for movement in unison therewith and multiple relatively reciprocable elongate ram portions extensibly mounted with respect to said base portion for extending and thereby moving said load carriage upwardly in response to the introduction of fluid under pressure into said ram assembly, a first one of said ram portions having an extensible end which is more extensible in a longitudinal direction than any other of said ram portions, the extensible end of said first ram portion being located nearer to the longitudinal midpoint of said mast than to the extensible end of said mast when said mast and ram assembly are fully contracted;

(d) means operatively interconnecting said mast, load carriage and ram assembly for moving said carriage upwardly, in response to introduction of fluid under pressure into said ram assembly, at predetermined ratios of the speed of said load carriage to the speed of extension of said ram assembly, the predetermined ratio thereof being less during an initial portion of said upward carriage travel than during a latter portion of said upward carriage travel;

(e) means within said ram assembly for extending said ram assembly, when fluid under pressure is introduced thereinto at a substantially constant rate, at different speeds of extension, the speed of extension of said ram assembly being greater during said initial portion of said upward carriage travel than during said latter portion of said upward carriage travel;

(f) a sheave mounted on said second mast section; and (g) flexible hydraulic conduit means trained about said sheave and having one end connected to said base portion of said ram assembly and the other end connected to said first mast section for introducing fluid under pressure into said ram assembly.

9. A load-lifting structure for an industrial lift truck or the like comprising:

(a) an extensible-contractible telescopic mast having first, second, third and fourth mast sections respectively and an extensible end, said second section being extensible from said first section, said third section being extensible from said second section and said fourth section being extensible from said third section;

(b) a load carriage movably mounted upon said mast for upward movement through a predetermined range of upward carriage travel;

(c) a single fluid-actuated, extensible-contractible fluid ram assembly comprising a base portion mounted upon said third mast section for movement in unison therewith and multiple relatively reciprocable elongate ram portions extensively mounted with respect to said base portion for moving said load carriage upwardly and extending said mast in response to the introduction of fluid under pressure into said ram assembly, a first one of said ram portions having an extensible end which is more extensible in the longitudinal direction than any other of said ram portions, the extensible end of said first ram portion being located nearer to the longitudinal midpoint of said mast than to the extensible end of said mast when said mast and ram assembly are fully contracted;

(d) means associated with said mast, load carriage and ram assembly for moving said carriage upwardly, when fluid under pressure is introduced into said ram assembly at a substantially constant rate, at respective speeds during initial and latter portions respectively of said range of upward carriage travel which differ, if at all, from each other by less than 50% of said speed during said initial portion of said range of upward carriage travel, said latter portion of said range of upward carriage travel occurring simultaneously with extension of said mast;

(e) a sheave mounted on said second mast section; and (f) flexible hydraulic conduit means trained about said sheave and having one end connected to said base portion of said ram assembly and the other end connected to said first mast section for introducing fluid under pressue into said ram assembly.

10. The load-lifting structure of claim 7 or 9 wherein said means associated with said mast, load carriage and ram assembly includes means for moving said load carriage upwardly without causing extension of said mast during said initial portion of said range of upward carriage travel at a speed substantially the same as the speed of said load carriage during said latter portion of said range of upward carriage travel.

11. A load-lifting structure for an industrial lift truck or the like comprising;

(a) an extensible-contractible telescopic mast having four relatively reciprocable mast sections and an extensible end;

(b) a load carriage movably mounted upon said mast for upward movement through a predetermined range of upward carriage travel;

(c) a fluid-actuated, extensible-contractible fluid ram assembly comprising multiple relatively reciprocable elongate ram portions for extending and thereby moving said load carriage upwardly in response to the introduction of fluid under pressure into said ram assembly, a first one of said ram portions having an extensible end which is more extensible in a longitudinal direction than any other of said ram portions, the extensible end of said first ram portion being located nearer to the longitudinal midpoint of said mast than to the extensible end of said mast when said mast and ram assembly are fully contracted;

(d) means operatively interconnecting said mast, load carriage and ram assembly for moving said carriage upwardly through respective initial and latter portions of said upward carriage travel, in response to introduction of fluid under pressure into said ram assembly, at respective first and second predetermined ratios of the speed of said load carriage to the speed of extension of said ram assembly, said first predetermined ratio substantially coinciding with said initial portion of said upward carriage travel and said second predetermined ratio substantially coinciding with said latter portion of said upward carriage travel, said first predetermined ratio being less than said second predetermined ratio;

(e) said ram assembly including means for extending said ram assembly, when fluid under pressure is introduced thereinto at a substantially constant rate, at respective first and second speeds of extension and for causing said first speed of extension to occur simultaneously with said initial portion of said upward carriage travel and for causing said second speed of extension to occur simultaneously with said latter portion of said upward carriage travel, said first speed of extension being greater than said second speed of extension, the relationship between said respective first and second speeds of extension being substantially inversely proportional to the relationsihip between said respective first and second predetermined ratios.

12. The load-lifting structure of claim 11 wherein said ram assembly includes means for changing from said first speed of extension to said second speed of extension prior to said latter portion of said upward carriage travel.

* * * * *